US008181705B2

(12) United States Patent
Tveiten et al.

(10) Patent No.: US 8,181,705 B2
(45) Date of Patent: May 22, 2012

(54) FLUID INJECTION DEVICE

(75) Inventors: Magnar Tveiten, Sandnes (NO); Øyvind Stokka, Sandnes (NO); Erling Kleppa, Jørpeland (NO); Tom Norland, Hommersåk (NO)

(73) Assignee: Petroleum Technology Company AS, Stavanger (NO)

( * ) Notice: Subject to any disclaimer, the term of this patent is extended or adjusted under 35 U.S.C. 154(b) by 500 days.

(21) Appl. No.: 12/278,155

(22) PCT Filed: Feb. 7, 2007

(86) PCT No.: PCT/NO2007/000040

§ 371 (c)(1),
(2), (4) Date: Aug. 4, 2008

(87) PCT Pub. No.: WO2007/091898

PCT Pub. Date: Aug. 16, 2007

(65) Prior Publication Data

US 2009/0025938 A1 Jan. 29, 2009

(30) Foreign Application Priority Data

Feb. 7, 2006 (NO) ..... 20060610

(51) Int. Cl.
*E21B 34/04* (2006.01)
*E21B 34/08* (2006.01)

(52) U.S. Cl. ..... 166/344; 166/321; 166/374; 137/538

(58) Field of Classification Search ..... 166/351, 166/368, 326, 339, 344, 268, 373, 374, 386, 166/321, 86.1, 86.3, 80.1, 95.1; 137/155
See application file for complete search history.

(56) References Cited

U.S. PATENT DOCUMENTS

| | | | | | |
|---|---|---|---|---|---|
| 2,846,014 | A | * | 8/1958 | Daffin et al. | 166/102 |
| 2,921,601 | A | * | 1/1960 | Fisher, Jr. | 137/496 |
| 3,011,511 | A | * | 12/1961 | Canalizo | 137/155 |
| 3,070,119 | A | * | 12/1962 | Raulins | 137/460 |
| 3,100,452 | A | * | 8/1963 | Grimmer et al. | 417/109 |
| 3,160,113 | A | * | 12/1964 | Meyers | 417/112 |
| 3,398,760 | A | * | 8/1968 | Fox et al. | 137/155 |
| 3,411,584 | A | | 11/1968 | Sizer | |
| 3,523,744 | A | * | 8/1970 | Holladay, Jr. | 417/115 |
| 3,552,490 | A | * | 1/1971 | Dollison | 166/320 |
| 3,595,315 | A | * | 7/1971 | Alley | 166/326 |

(Continued)

FOREIGN PATENT DOCUMENTS

CA 2461485 9/2004

(Continued)

*Primary Examiner* — Thomas Beach
*Assistant Examiner* — Matthew Buck
(74) *Attorney, Agent, or Firm* — Christian D. Abel

(57) ABSTRACT

The present invention regards a device designed for injection of fluids in a well bore, typically an offshore well bore for petroleum production and gas injection/gas lift system for fluid injection. The device comprises a outer hollow housing (1) with an internal body (2) moveable within the outer housing (1) with an internal bore (3) which in a first closed position is closed with a metal to metal seal system between the outer housing (1) and the internal body (2), which internal body (2) is operated by pressure differential across the internal body (2), where the internal body (2) is designed with slots (4) forming outlets of the internal bore (3) which in an open position of the device leads to the outside of the outer housing (1).

21 Claims, 1 Drawing Sheet

U.S. PATENT DOCUMENTS

| | | | | | |
|---|---|---|---|---|---|
| 3,603,394 | A | * | 9/1971 | Raulins | 166/325 |
| 3,752,183 | A | * | 8/1973 | Griswold | 137/504 |
| 3,973,586 | A | * | 8/1976 | Hill et al. | 137/460 |
| 3,973,587 | A | * | 8/1976 | Cochran | 137/496 |
| 4,067,350 | A | * | 1/1978 | Raggio | 137/155 |
| 4,398,555 | A | | 8/1983 | Taylor | |
| 4,462,465 | A | | 7/1984 | Strickland | |
| 4,487,221 | A | * | 12/1984 | Zwart | 137/508 |
| 4,494,608 | A | | 1/1985 | Williams | |
| 4,565,215 | A | | 1/1986 | Cummings | |
| 5,004,007 | A | * | 4/1991 | Johnson et al. | 137/501 |
| 5,009,393 | A | | 4/1991 | Massey | |
| 5,105,852 | A | | 4/1992 | Wagner | |
| 5,215,254 | A | * | 6/1993 | Haruch | 239/107 |
| 5,479,988 | A | * | 1/1996 | Appleton | 166/325 |
| 5,779,148 | A | * | 7/1998 | Saarem et al. | 239/104 |
| 5,794,917 | A | * | 8/1998 | Sahm et al. | 251/176 |
| 6,148,843 | A | * | 11/2000 | Pringle | 137/155 |
| 6,196,259 | B1 | * | 3/2001 | Weber | 137/504 |
| 6,460,620 | B1 | * | 10/2002 | LaFleur | 166/324 |
| 6,631,767 | B2 | | 10/2003 | Pringle | |
| 7,814,982 | B2 | * | 10/2010 | Moyes | 166/373 |
| 2006/0124884 | A1 | * | 6/2006 | Dnestrianschii et al. | 251/231 |
| 2007/0215358 | A1 | * | 9/2007 | Messick et al. | 166/372 |
| 2009/0065215 | A1 | * | 3/2009 | Tveiten et al. | 166/368 |
| 2010/0212908 | A1 | * | 8/2010 | Stokka et al. | 166/319 |

FOREIGN PATENT DOCUMENTS

| | | |
|---|---|---|
| FR | 1532450 | 7/1968 |
| FR | 2845726 | 4/2008 |
| GB | 915586 | 1/1963 |
| GB | 2149018 | 6/1985 |
| GB | 2239472 | 7/1991 |
| GB | 2405920 | 3/2005 |
| WO | 02/31311 | 4/2002 |
| WO | 03/029705 | 4/2003 |
| WO | 2004/092537 | 10/2004 |
| WO | WO 2004092537 A1 * | 10/2004 |

* cited by examiner

Fig. 4
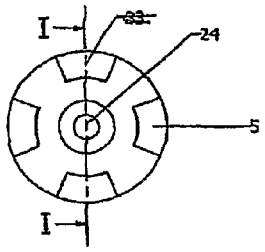
Fig. 1
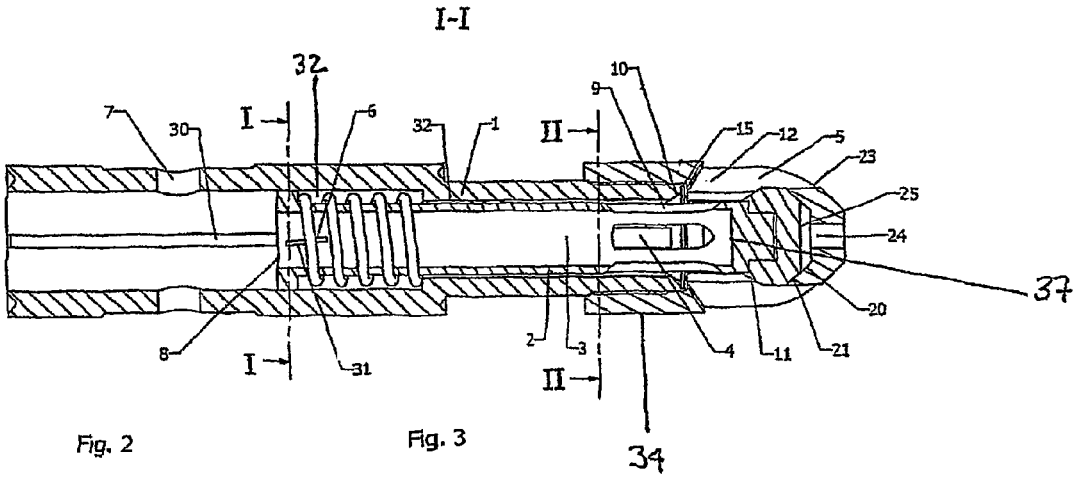
Fig. 2
Fig. 3
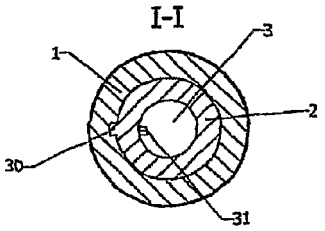
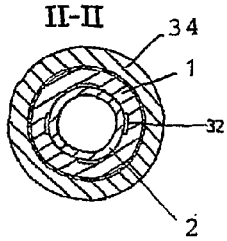
Fig. 5
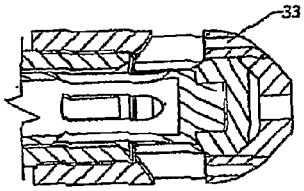

FLUID INJECTION DEVICE

FIELD OF THE INVENTION

The present invention regards a device for injection of fluid in a well bore, typically an offshore well bore for petroleum production and gas injection/gas lift system.

BACKGROUND

There are known several different principles of operating a gas injection valve, one of this is based on the venturi principles, for instance described in WO 2004/092537 A1. Another approach is to have a central stem with outer sealing surface and through going flow between an outer housing and the central stem across the sealing surfaces, for instance described in CA 02461485 A1.

After a period of time, known gas lift valves will have a tendency of not working as expected. One problem might be the erosion of the sealing surfaces of the valve device which lead to leakage across the valve seat and reduced performance and a reduced lifetime for the valve devices. This creates a problem for operation of the well with increased down time, maintenance time and an increased safety hazard.

SUMMARY OF THE INVENTION

An aim with the present invention is to minimize and possibly alleviate these problems. It is also an aim to provide a device with a true metal to metal sealing of the device. Metal to metal seal in a preferred embodiment is understood to be a single seal between two metallic surfaces without any secondary seal, soft seal or a combination of such. It is also an aim to provide a device with a reduced erosion rate of the sealing surface. Another aim is to provide a device with an increased flow area compared with similar known valves. There is a further aim to provide a device with minimal flow restrictions and disturbances in the injection flow, giving reduced pressure losses across the device. There is also an aim to provide a device with a low operating pressure difference.

These aims are achieved by a device according to the following claims and alternative embodiments are given in the description . . . .

The present invention regards a device designed for injection of fluids in a well bore, typically an offshore well bore for petroleum production and gas injection/gas lift system for fluid injection. The device may also be used for injection of other constituents such as well stimulation fluids, cutting injection, water injection etc. The device comprises an outer hollow housing with an internal body (a so-called dart) moveable within the outer housing. The housing can be manufactured in one unit, or it can alternatively comprise several parts, such as a main part and a corresponding nose. According to the invention the internal body comprises an internal bore which in a first closed position is closed with a metal to metal seal system between the outer housing and the internal body. The movement of the internal body is operated by pressure differential across the internal body. This pressure differential may be a fluid pressure operating on surfaces of the internal body, which surfaces may be exposed to different fluids. These fluids may be well fluids on one or more surfaces for operating the device or injections fluid on one surface and well fluid on another surface or combinations. According to an aspect the pressure differential across the internal body may be assisted by at least one predetermined pressure balanced elastic element to open and close the device.

According to the invention the internal body comprises at least one slot between the bore and the outside of the internal body. These slots in the internal body are, in an open position of the device, leading to the outside of the outer housing. According to an aspect of the invention the outer housing may comprise slots between an internal surface of the outer housing and an outer surface of the outer housing. These slots in the outer housing correspond with the slots in the internal body in an open position of the device.

According to another aspect the slots may be longitudinal and distributed on the circumference of the inner body and outer housing of the device. The distribution may be evenly around the circumference of the internal body. The form of the slot may be even or odd around the circumference of the body. The slots may be longitudinal with a main longitudinal direction mainly parallel with a longitudinal axis of the internal body. The slots may be longitudinal with a main direction at an angle relative to the longitudinal axis of the internal body or for a part spiral shape around a longitudinal axis, or formed with another shape.

According to another aspect the slots in the internal body and or the outer housing may be made beveled and angled from an internal surface to an outer surface of the internal body and or outer housing in order to obtain stream line flow from the internal bore and to the outside of the device.

According to another aspect of the invention the slots in the internal body and or outer housing may be placed in a way to prevent the stream line flow to strike the sealing surfaces.

According to another aspect of the invention the internal body comprises a orifice positioned on opposite end of the slots seen in a longitudinal direction of the device and connected with the internal bore, where the orifice is formed to obtain rotation of the injected fluid when the injected fluid enters the internal bore.

According to another aspect of the invention the outer housing comprises at least one through-going outlet. These outlets may be longitudinal and parallel with a longitudinal axis of the outer housing and are arranged evenly around a circumference of the outer housing. The outlets may also be longitudinal and angled relative to the longitudinal axis of the outer housing. Further, the outlets may be connected with the slots in the outer housing or they may be arranged as separate outlets in the outer housing. Their function are to bring forth in the injected fluid the ability to penetrate the production flow in the tubing, thereby gaining a better incorporation of the injected fluid in the flow.

According to another aspect of the invention the seal system comprises a valve seat in the outer housing and a valve element sealing surface on the internal body, which in an open position of the device are positioned mainly outside the injection fluid stream. With open position one should in this description understand a position wherein the slots of the internal body are at least partly overlapping the slots of the outer housing seen in a direction transverse to the longitudinal axis of the device.

According to another aspect of the invention the valve seat and the valve element sealing surface in an open or partially open position are positioned on opposite sides of a slot seen in a longitudinal direction of the device. The valve element sealing surface is positioned mainly outside the flow of injection fluid through the device, since it in an embodiment is at least partly covered by a part of the outer housing. The valve seat is positioned outside the flow of injection fluid through the device, at least partly covered by the internal body. This gives that the slots forming the flow path of the injection fluid are positioned between the valve seat and the valve element sealing surface. The shape and size of the slots in the internal body and outer housing may be equal or different. The valve seat arranged in the outer housing is arranged in a distance from slot in outer housing, and valve element surface arranged on internal body is arranged in a distance from slot in internal body. This gives that the sealing surfaces of valve seat and sealing element will not experience that the injected fluid forms a full flowing pattern in contact with these surfaces.

According to another aspect of the invention the valve seat may comprise a low pressure guide to obtain optimal guiding sealing engagement.

According to another aspect the internal body comprises a stop surface which in a fully open position of the device is abutting against a corresponding surface (the nose) in the outer housing. This stop surface may be positioned on one end of the internal body close to the outlet of the device, preferably on an opposite side of the slots compared with an inlet for the injection fluid into the intended bore and thereby prevent vibration in the internal body of the injection fluid, in an open position of the device.

According to another aspect of the invention the internal body comprises a pressure surface exposed to the well fluid in an open position of the device, biasing the device towards a closed position.

According to another aspect of the invention the internal body and outer housing may comprise corresponding parts of at least one guiding element predefining a travel between a closed and an open position of the device. In addition or alternatively the internal body may comprise at least one fluid balanced wing(s) or baffle(s) and or added slots in the internal surface of the internal body exposed to the injection fluid to guide the internal body in a predetermined travel between open and closed position of the device. This predefining travel may be linear, rotational and or a combination of this.

According to another aspect of the invention the device further may comprise at least one element for overriding and or controlling the open and or closed position of the device.

According to another aspect of the invention the outer housing may comprise a wiper element positioned to abut against and clean the sealing surface during closing of the device. This is favorable in the case when the injection fluid contains particles prone to be attached to the sealing surfaces.

According to another aspect of the invention the elastic element may comprise a spring element enclosed in a chamber, which chamber is filled with a fluid separate from both well and injection fluid.

These features of the invention will provide a device where the flow path of the injection fluid is substantially less tortuous than other known gas injection valves due to the more direct flow through the bore in the internal body and directly out through the slots. This also gives less pressure losses across the valve. By designing the inlets, orifice, outlets and the slots of the device, one could achieve the desired effect with regard to flow pattern and cavitations. The present invention is also a simplified device with few elements, compared with the majority of other known injection valves. This gives a more reliable device as well. The present invention also has a relatively large flow area through the device; compared with the majority of other known injection valve of similar size.

BRIEF DESCRIPTION OF THE DRAWINGS

Following there will be given a non-limiting description of an embodiment of the invention with reference to the accompanying drawings, where FIG. 1 shows a cross section of a first embodiment of the present invention FIG. 2 shows a cross section along line I-I of the embodiment shown in FIG. 1.

FIG. 3 shows a cross section along line II-II of the embodiment shown in FIG. 1.

FIG. 4 shows a front view of the first embodiment of the present invention in FIG. 1, and FIG. 5 shows a cross section of the foremost part of the device, of a second embodiment of the present invention.

DETAILED DESCRIPTION

In FIG. 1 there is shown a first embodiment of a device according to the invention. This embodiment is a gas lift valve for positioning in a well stream. A skilled person will understand how this is done and this is therefore not described in this application.

In the FIG. 1 the device, normally used as a gas lift valve, but the principle may be used for other kind of injection valves, comprises an outer housing 1 with an internal body 2 movable within the outer housing 1 between two positions. As can be seen in the figure, the outer housing in this embodiment comprises two parts, that is, the main part 1 and the nose 34. The nose 34 is connected to the main part 1 with suitable means, for instance as a threaded joint. An open position is shown in FIG. 1. The internal body 2 is movable in the longitudinal direction of the internal body 2 and outer housing 1. The outer housing 1 comprises injection fluid inlets 7 close to an end of the outer housing 1. These inlets 7 are in contact with an injection fluid source (not shown). From the inlets 7 the injection fluid is transferred through an internal void of the outer housing 1 through an orifice 8 (just indicated) into an internal bore 3 of the internal body 2. The orifice 8 is situated on one end of the internal body 2, and forms part of the internal bore 3. Furthermore, the orifice is designed to create a rotational flow in the injected fluid as it enters the bore 3. The bore 3 stretches in the longitudinal direction of the internal body 2 from an end of the internal body 2 and almost to the other end of the internal body 2. The injection fluid will thereafter in an open position of the valve flow through slots 4 leading from the internal bore 3 to the outside of the internal body 2. There is in the shown example shown four slots 4, there may of course be less or more slots around the circumference of the device. In an open position of the valve these slots 4 of the internal body 2 cooperate with slots 5 in the outer housing 1, leading the injection fluid out into the process fluid flow, wherein the device is positioned. This gives a flow pattern in an open position of the valve for the injection fluid which is with a minimum amount of bends, giving minimal pressure losses across the valve. To improve the flow pattern a surface 9 of the slots 4 between an internal to an external side of the internal body 2 and a similar surface 12 of the slots 5 in the outer housing 1, may be angled with angles other than 90 degrees with a longitudinal axis of the device. The surfaces 9 and or 12 may also be formed with varying angles dependent on where around the slot 4, 5 the part of the surfaces 9, 12 it is. The angles of the surfaces 9, 12 of the slots 4 of the internal body 2 and the slots 5 of the outer housing 1, may also be different.

In one embodiment the device are formed with four small and four large slots 33, 5 around the circumference of the device, thereby splitting up the flow in droplets and or squirts.

An internal bottom 37 of the internal body 2 close to the end, where the slots 4 are placed, is shaped either as a flat bottom (as shown in FIG. 1) or a countersunk bottom. When large particles (larger than 20 microns) hit the flat bottom of the internal body 2, they will loose all their energy and thereafter they will follow the flow out of the valve. The internal bottom of the internal body 2 may also be covered by a resilient material, for instance rubber. Further, by shaping the bottom of the internal body 2 as a countersunk bottom, one could also influence the direction of which the particles leave the slots 4, 5. The valve shown also comprises an elastic element 6 arranged between a shoulder of the outer housing 1 and a shoulder of the internal body 2, biasing the internal body 2 to a closed position of the valve (not shown). When the pressure differential across the internal body 2 reaches a set limit this pressure difference will move the internal body 2 against the elastic element to an open position, or the pressure from the elastic element will move the internal body 2 to a closed position of the valve.

The internal body 2 comprises an annular, valve element sealing surface 11, with a mainly conical shaped surface. This surface 11 is arranged close to an end of the internal body 2 with the end of the conical shaped surface 11 with the larger diameter, furthest away from the slots 4 of the internal body 2. The slots 4 are arranged close to an end of the internal body 2, and the surface 11 closer to the same end of the internal body 2. The sealing surface 11 of the internal body cooperates with a vale seat 10 arranged in the outer housing 1. The valve seat 10 in the outer housing 1 is arranged on the relative speaking other side of the slot 4,5, when these are aligned in an open position, compared with the sealing surface 11 of the internal body 2, seen in a longitudinal direction of the device. In a closed position, the internal body 2 is moved relative the outer housing 1 so that the sealing surface 11 is abutting the valve seat 10, giving a sealed, metal to metal seal for the valve. In this closed position the slots 4 of the internal body 2 will be positioned within the valve device and the slots 5 of the outer housing on the other side of the interaction between the sealing surface 11 and the valve seat 10. There is in connection with the valve seat 10 in the outer housing 1 arranged a low pressure guide 15, at the end of the valve seat 10 with the larger diameter. This gives a guiding of the valve element surface 11 towards the valve seat 10, to make good contact and a sealing connection. The low pressure guide 15 may also have a sealing function. The sealing surface on the internal body 2 and the valve seat 10 in the outer housing 1 will in an open position of the device be at least partly covered by the other element of the device, outer house and internal body respectively.

At the end of the internal body 2 close to the slots 4, there is in addition arranged a stop surface 21, which stop surface 21 abut a corresponding stop surface 20 in the outer housing 1, limiting the movement and travel of the internal body 2 relative the outer housing 1 in a fully open position of the valve, where the slots 4 and slots 5 are fully aligned. This stop surface 20, 21 will by their interactions also limit the vibration of the internal body 2 in an open position of the device by being arranged an opposite end of the internal body 2 compared to the elastic element 6, in relation to the slots, giving a two point contact between internal body 2 and outer housing 1 in an open position of the device.

The outer body is further arranged with a pressure inlet 24 at the end of the device. This pressure inlet 24 is open between the process fluid around the valve and a pressure surface 25 of the internal body 2. The pressure surface 24 affected by the pressure in the process fluid, together with a back pressure surface 23 arranged at an end of the internal bore of the internal body 2, giving a pressure difference across these two surfaces, will aid in moving the internal body 2 relative the outer housing 1.

In the embodiment shown there is also shown a guiding element 30 as a groove in the outer housing 1 and a protrusion (not shown in FIG. 1 but in FIG. 2) of the internal body 2 cooperating with the groove, best seen in FIG. 2. This guiding element 30 limits or controls the rotational movement of the internal body 2 relative the outer housing 1 when the internal body 2 is moved in the longitudinal direction relative the outer housing 1, giving the internal body 2 a linear or predetermined rotating travel or even a combination with linear in one direction and rotating in the opposite direction. Another possible solution to influence or control this rotational movement is also shown in FIG. 1 and FIG. 2 and that is to arrange balancing wings 31 within the internal bore 3 of the internal body 2. The injection fluid flowing through the internal bore will affect the movement of the internal body 2. There may be one or several of these elements arranged around within the circumference of the internal bore and or inside the outer housing.

As can be seen in FIG. 3, there is arranged grooves 32 in the outer housing 1, where these grooves 32 forms a canal between the internal body 2 and the outer housing 1. The grooves 32 elapses from the internal shoulder 36 of the outer housing and longitudinally with a longitudinal axis of the outer housing 1, where the grooves 32 may run into the slots 5 of the outer housing 1. The grooves 32 will allow any fluid present in the grooves 32 to freely move when the elastic element 6 is compressed, therby preventing a "locking" of the internal body 2, between the outer housing 1, the elastic element 6 and the internal body 2.

In FIG. 4 shows a cross section of the first embodiment of the present invention, where four slots 5 are arranged around the circumference of the outer housing 1; in this embodiment the slots are positioned directly opposite each other, and they cooperate, as earlier mentioned, with the slots 4 of the internal body 2.

FIG. 5 is the cross section of the foremost part of the device, of a second embodiment of the present invention and show the area around the slots 5 of the outer housing 1 where one or more through-going outlets 33 are arranged around the circumference of the outer housing. The outlets 33 are longitudinal, circular in form and mainly parallel with a longitudinal axis of the outer housing 1. The outlets 33 are further connected with the slots 5 and their function are to bring forth in the injected fluid the ability to penetrate the production flow in the tubing, thereby gaining a better incorporation of the injected fluid in the flow.

Only elements related to the invention is described and a skilled person will understand that an outer housing or internal body may be formed in one unit or be comprised of several connected elements, and that the inlets have to be connected to a source of the fluid to be injected, that there should be appropriate attachment devices for attaching the valve within a process fluid stream, and that there of course will be arranged for instance sealing element between several elements as a standard. The skilled person will also understand that one may make several alterations and modifications to the described and shown embodiment that are within the scope of the invention as defined in the following claims.

The invention claimed is:

1. Device for injection of fluids in a process fluid, where the device comprises an outer hollow housing with at least one inlet and outlet, a pressure inlet and an internal body movable within the outer housing in a longitudinal direction of the outer hollow housing, where the internal body comprises an orifice and at least a slot being connected by an internal mainly longitudinal bore for flow of injection fluids from the inlet to the outlet, which outlet in a closed position is closed with a seal system between the outer hollow housing and the internal body, the injection fluids having a mainly linear flow through the bore in an open position of the device, the movement of the internal body for closing or opening the outlet being operated by pressure differential across the internal body, wherein the longitudinal bore in an opposite end of the orifice is terminated in an internal bottom of the internal body, the internal bottom forming a back pressure surface which is exposed to pressure from injection fluids, the internal body further comprising a pressure surface which is exposed to pressure from process fluid, the pressure surface being opposite the internal bottom, where the pressure difference between the back pressure surface and the pressure surface moves the internal body relative the outer housing.

2. Device according to claim 1, wherein the outer housing comprises at least a slot corresponding to the at least one slot of the internal body in an open position of the device.

3. Device according to the claim 2, wherein at least one outlet is arranged around the circumference of the outer hollow housing, where the outlet further is connected with the slots.

4. Device according to claim 2, wherein the pressure differential across the internal body is assisted by at least one predetermined pressure balanced elastic element to open and close the device, by overlapping of the slots.

5. Device according to claim 2, wherein the slots are longitudinal and distributed on the circumference of the inner body and outer housing of the device.

6. Device according to claim 5, wherein the slots in the internal body and the outer housing are beveled and angled from an internal surface to an outer surface of the internal body and outer housing in order to obtain stream line flow.

7. Device according to claim 2, wherein the longitudinal slots in internal body and outer hollow housing are parallel to a longitudinal direction of the device or twisted or bent around the longitudinal axis.

8. Device according to claim 5, wherein the slots in the internal body or outer hollow housing are placed between sealing surfaces, in a way to prevent the stream line flow to strike the sealing surfaces.

9. Device according to claim 8, wherein the seal system comprises a valve seat in the outer housing and a valve element sealing surface on the internal body, where the sealing surface in an open position of the device are positioned outside the injection fluid stream and in a closed position together with the valve seat form a metal to metal seal system.

10. Device according to claim 9, wherein the valve seat and the valve element sealing surface in an open or partially open position are positioned on opposite sides of the slot seen in a longitudinal direction of the device.

11. Device according to claim 9 or 10, wherein the valve seat arranged in outer housing is arranged in a distance from slot in outer housing, and valve element surface arranged on internal body is arranged in a distance from slot in internal body, where valve seat and valve element surface are arranged on different ends of the slots seen in a longitudinal direction of the device.

12. Device according to claim 11, wherein the valve seat comprise a low pressure guide to obtain optimal sealing engagement.

13. Device according to claim 1, wherein the internal body comprises a stop surface which in a fully open position of the device is abutting against a corresponding surface in the outer housing.

14. Device according to claim 1, wherein the internal body and outer housing comprise corresponding guiding elements predefining a travel between a closed and an open position of the device.

15. Device according to claim 1, wherein the internal body comprises fluid balanced wings or baffles or added slots in the internal surface of the internal bore exposed to the injection fluid to guide the internal body in a predetermined travel between open and closed position of the device.

16. Device according to claim 1, wherein the orifice positioned on opposite side of the slots is designed to obtain a rotation of the injected fluid.

17. Device according to claim 1, wherein the device further comprises elements for overriding or controlling the open and or closed position of the device.

18. Device according to claim 1, wherein the outer housing comprises a wiper element positioned to abut against and clean the sealing surface during closing of the device.

19. Device according to claim 4, wherein the elastic element comprises a spring element enclosed in a chamber, which chamber is filled with a fluid separate from both well and injection fluid.

20. Device according to claim 1, wherein the internal bottom of the internal body at the end with the slots is shaped as a flat or countersunk bottom.

21. Device according to claim 1, wherein the outer hollow housing comprises a main part and a nose.

* * * * *